US007108552B2

(12) United States Patent
Niitsu et al.

(10) Patent No.: US 7,108,552 B2
(45) Date of Patent: Sep. 19, 2006

(54) CONNECTOR FOR HIGH-RATE TRANSMISSION

(75) Inventors: Toshihiro Niitsu, Machida (JP); Shinichi Matsuzaki, Tokyo (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/490,407

(22) PCT Filed: Sep. 25, 2002

(86) PCT No.: PCT/JP02/09869

§ 371 (c)(1),
(2), (4) Date: Oct. 18, 2004

(87) PCT Pub. No.: WO03/028169

PCT Pub. Date: Apr. 3, 2003

(65) Prior Publication Data

US 2005/0118876 A1 Jun. 2, 2005

(30) Foreign Application Priority Data

Sep. 25, 2001 (JP) ..... 2001-290975

(51) Int. Cl.
*H01R 13/648* (2006.01)

(52) U.S. Cl. ..... 439/607; 439/941

(58) Field of Classification Search ..... 439/79, 439/607, 609

See application file for complete search history.

(56) References Cited

U.S. PATENT DOCUMENTS 4,718,866 A 1/1988 Yamaguchi
6,106,338 A * 8/2000 Wu et al. ..... 439/660
6,261,129 B1 * 7/2001 Kusagaya ..... 439/677
6,358,089 B1 * 3/2002 Kuroda et al. ..... 439/607
6,371,811 B1 * 4/2002 Chen et al. ..... 439/607
6,508,678 B1 * 1/2003 Yang ..... 439/677

FOREIGN PATENT DOCUMENTS

JP 7106027 4/1995
JP 2002216910 A 8/2002

OTHER PUBLICATIONS

International Patent Application Serial No. WO 96/30971 (The Whitaker Corporation), Oct. 3, 1996.
International Search Report in PCT Application No. PCT/JP02/09869, the PCT parent of the present application, mailed Nov. 12, 2002.

* cited by examiner

*Primary Examiner*—Thanh-Tam Le
(74) *Attorney, Agent, or Firm*—Thomas D. Paulius

(57) ABSTRACT

A high speed transmission connector includes a base board side connector and a cable side connector to be connected with each other and a metal shell which covers a housing and contacts arranged in the housing. By inserting the metal shell of the cable side connector into the metal shell of the base board side connector, the contacts and the metal shells are respectively connected electrically. The metal shell of the base board connector includes a recess portion for adjusting a space between the metal shell and the contact in the base board side connector. With this invention, the characteristic impedance can be adjusted with an easy method and can sufficiently cope with the miniaturization of the connector and with a higher density.

15 Claims, 8 Drawing Sheets

CONNECTOR FOR HIGH-RATE TRANSMISSION

FIELD OF THE INVENTION

The present invention relates to a high speed transmission connector in which an impedance matching function is given to a metal shell covering a housing where a plurality of contacts are arranged.

BACKGROUND OF THE INVENTION

For a high speed transmission connector, particularly for a connector or a cable located on a transmission path of a differential signal, a characteristic impedance matching is required, in addition to the requirement for a simple and easy inter-connection of the existing apparatus.

For example, in a connector for communication in an audio/visual apparatus, reduction of the number of connectors to be connected and miniaturization of the connector per se have been continuously required, and in addition, the following problem has arisen as a new requirement for the connector in line with the new high speed digital transmission. That is, when there is an impedance mismatch in the connector portion, a signal of an image or sound is deformed or reflection occurs, and, as a result, the image or sound cannot be properly reproduced. Therefore, in such a connector to be inserted into a high frequency signal transmission path, the matching performance of the impedance is also one of the important requirements.

Japanese Patent Laid-Open Publication No. Hei 7-106027 discloses a technology considering characteristic impedance of a connector. In this technology, a high frequency signal transmission path is realized by a contact having a non-coaxial structure and constructing a control signal transfer path by also the same contact parts whereby the low cost and the miniaturization may be attained.

In a recent signal transmission connector, the outside of a housing where contacts are arranged is covered with the metal shell. This is because, by covering the housing with the metal shell, the noise or loss due to the generation of an electromagnetic wave radiation may be effectively prevented.

In the case where this kind of connectors is a pair of connectors (composed of a male connector and a female connector) to be coupled with each other, metal shells are provided, as an electromagnetic shield, for the respective connectors. At the time of coupling, generally, the metal shell on one connector is inserted into the metal shell on the other connector so that the metal shells are electrically connected to each other, thereby to place it in a mode where these potentials are maintained at an equal level and the grounding is to be made.

The metal shells of the two connectors are formed into a sleeve-shape having an engaging portion for coupling with each other. Therefore, since the metal shell of one connector is inserted into the metal shell of the other connector, the metal shell and the connector placed therein are inevitably most closed to each other. As a result, there arises a problem of mismatch in impedance at the engaging portion.

In this respect, some conventional connectors adopted a method of adjusting the characteristic impedance on the basis of a pitch of the contacts, the width dimension of the contacts, or on the basis of an induction rate of an insulator (housing) for holding the contacts.

However, with these methods, there are various drawbacks in designing and manufacturing the connectors, in that, for adjusting the characteristic impedance, the connector itself or its pitch is widened, thereby sacrificing the miniaturization and high density aspects of the connector. In addition, for the contacts to be made of a plate material, it must be selected from materials having a thickness which is not generally available on the market.

OBJECT AND SUMMARY OF THE INVENTION

Therefore, an object of the present invention is to provide a high speed transmission connector capable of easily adjusting the characteristic impedance and of sufficiently coping with making the connector miniaturized and having higher density.

The high speed transmission connector according to the present invention is comprised of a pair of connectors (namely, a female connector and a male connector) to be coupled with each other; wherein each connector is provided with a metal shell for covering a housing and contacts arranged within the housing and the metal shell of one connector is inserted into the metal shell of the other connector, thereby the metal shells as well as the contacts are electrically connected, respectively, and a recess portion, such as the depression or dimple shown, is provided in the metal shell of one connector for adjusting an interval between the contact and the metal shell of the other connector.

According to the present invention, since a recess portion is provided for adjusting a space between the contact and the metal shell within one connector, it is possible to perform matching of the impedance by the action of this recess portion. That is, the recess portion is not provided by using a separate member but can be easily formed by press-machining or embossing the metal shell. In addition, it is also easy to adjust a depth of the recess portion. Therefore, it is possible to easily adjust the impedance by means of this recess portion. This is because the impedance of the connector is changed greatly depending upon the space between the metal shell and the contact.

It is preferable that the space between the contact and the recess portion in one of the connectors be set to be substantially equal to the space between the contact and the metal shell in the other connector. Thus, with this structure, since the overall length of the space between the contact and the metal shell in the connectors, after engagement with each other, becomes substantially equal to each other, matching of the impedance also becomes easy.

Here, the recess portion of the metal shell may be provided in plural. For the recess portion, a single large recess portion may be provided. However, in the case where, for example, the recess portion is formed by press-machining, forming a plurality of recess portions is easier by press-machining and easy to secure the mechanical strength of the metal shell. Further, in the case where the contacts are plural, the plurality of recess portions may correspond to the plurality of contacts with high precision.

It is preferable that in each connector a plurality of contacts are arranged at intervals in a widthwise direction of the connector. By arranging the contacts in the widthwise direction of each connector, it is possible to attain the high density and, in addition, to easily make each contact correspond to the respective recess portions.

The recess portions are arranged with intervals in a direction of width of the connector. With this arrangement, the plurality of recess portions can be formed in a rectangular shape or an oval shape without difficulty and with a high density.

Also, it is preferable that each recess portion is provided in a plate portion of the metal shell of one connector adjacent to an engaging portion into which the other connector is inserted. With this structure, it is possible to avoid the adverse influence on the region of the coupling portion of the connectors by the existence of the recess portion. That is, the bottom of the recess portion projects inwardly from the inner surface of the metal shell but the recess portion is displaced from the region of the coupling portion of the connectors. Therefore, it is possible to obtain a structure that is good in attempting miniaturization and thinning of the connector having a higher density.

It is preferable that the recess portion is provided on the metal shell, which is in the vicinity, particularly above or below, of the contact which transmits a differential signal. With such structure, each differential signal can be transmitted properly without degrading the quality of the signal.

At this time, a portion corresponding to the bottom of the recess projecting inwardly may be made a stopping portion to which the metal shell of the other connector hits, thereby to precisely define an engagement position of the two connectors.

Further, locking means may be provided on the metal shell of either one of the connectors or both connectors, so as to lock the connectors with each other. This locking means assures the effect of the electrical connection between the metal shells and to exhibit a locking function.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE DISCLOSED EMBODIMENTS

Figure 1:
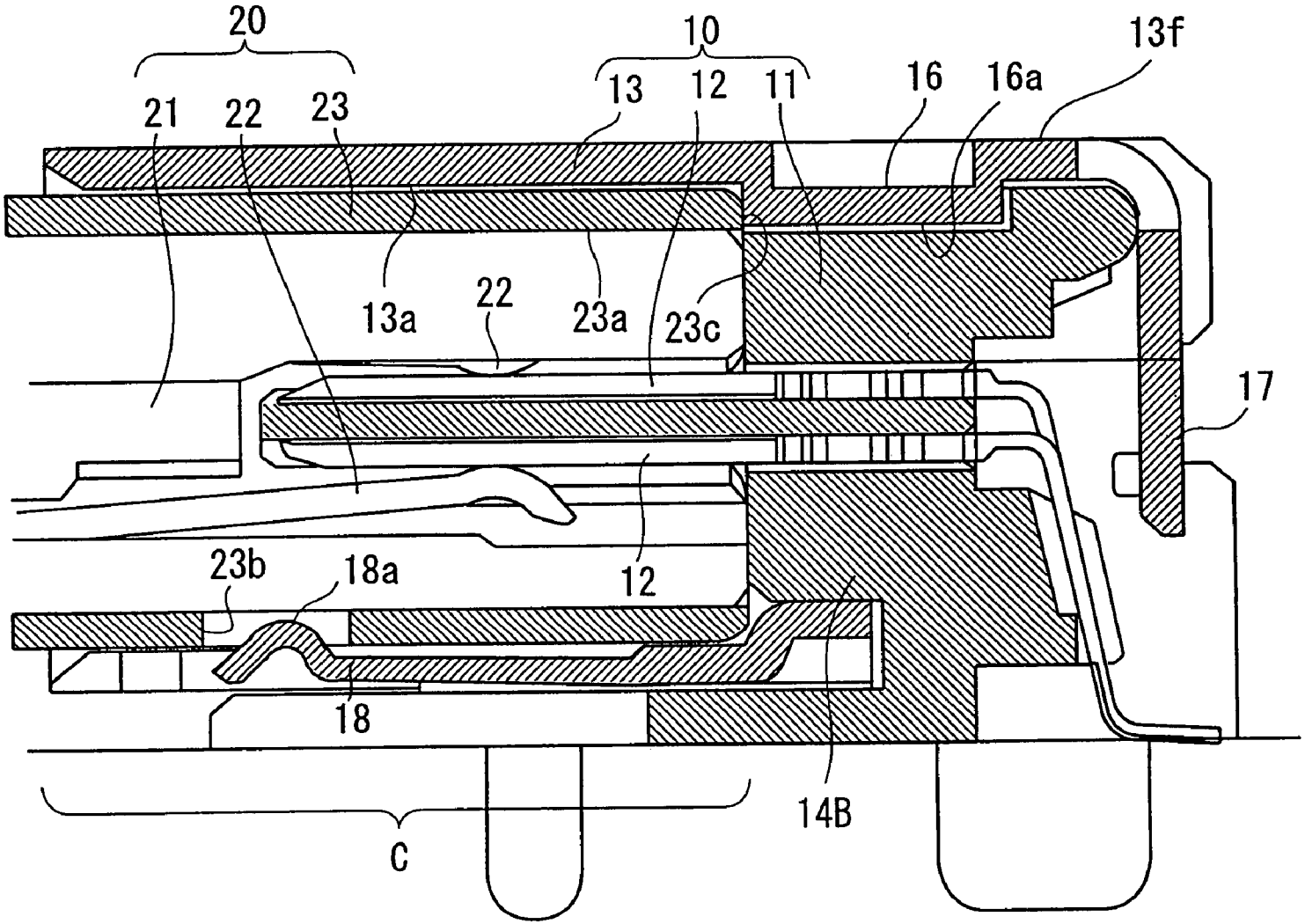
FIG. 1 is a cross-sectional view of the essential portions of a connector on the side of a base board and a connector on the side of a cable according to a first embodiment of the present invention, wherein the upper and the lower contacts are schematically shown in the same cross-sectional view.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 2:
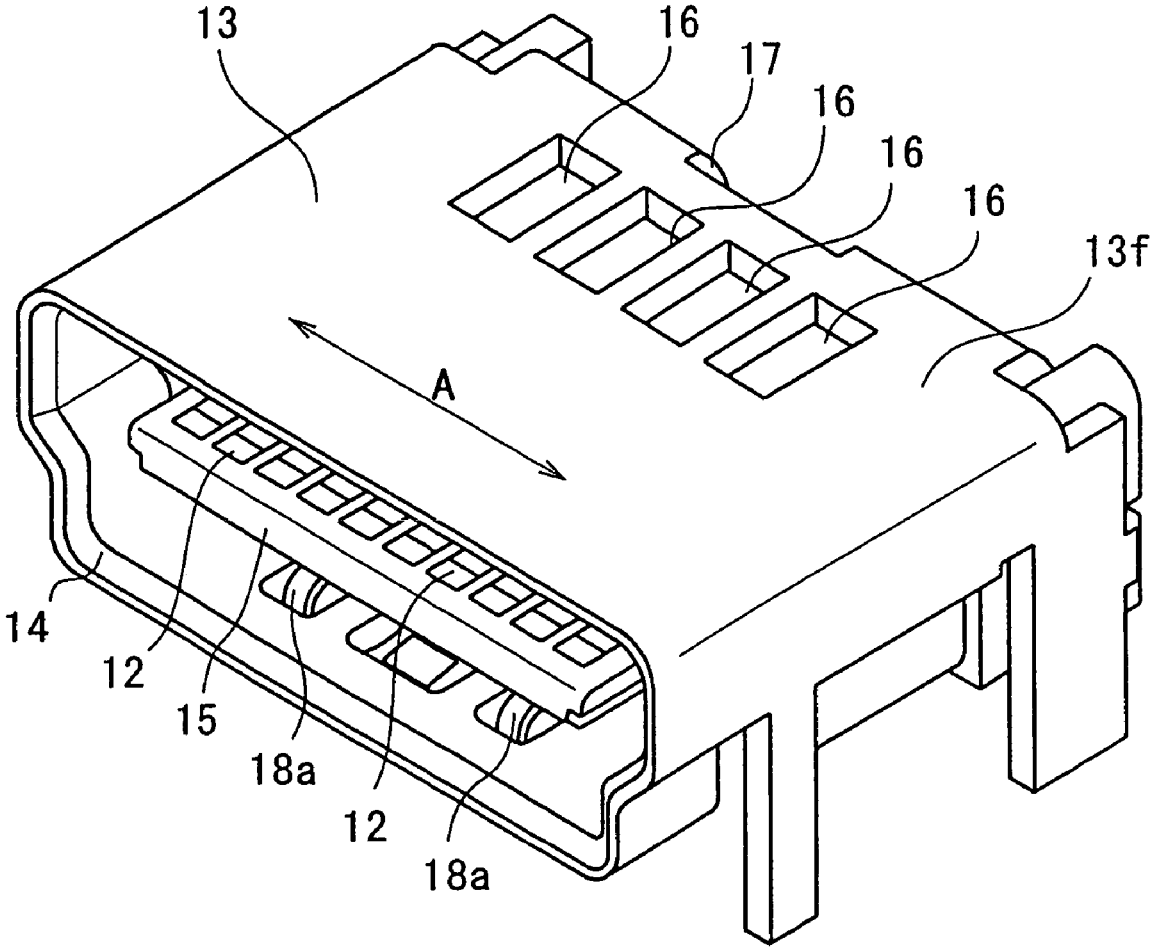
FIG. 2 is a perspective view of the connector on the side of the base board according to the first embodiment of the present invention.
Figure 3:
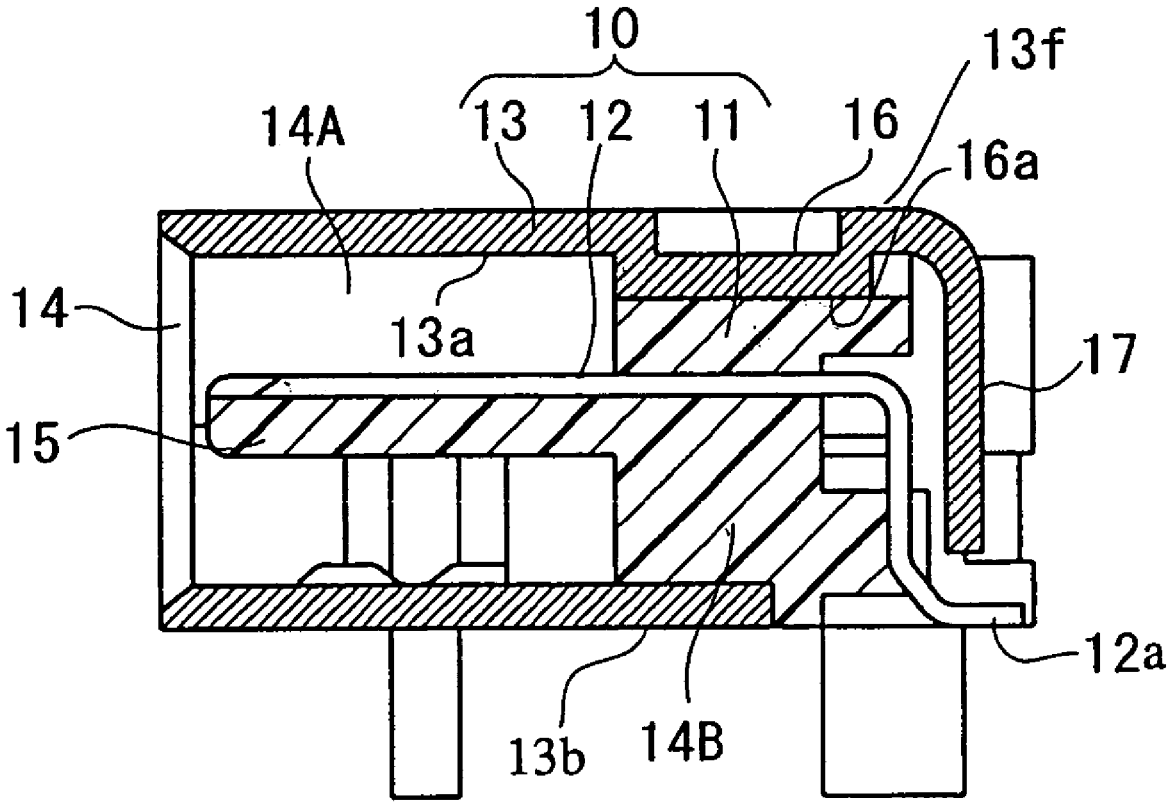
FIG. 3 is a cross-sectional view of the connector on the side of the base board according to the first embodiment of the present invention, showing only the upper side contact.
Figure 4:
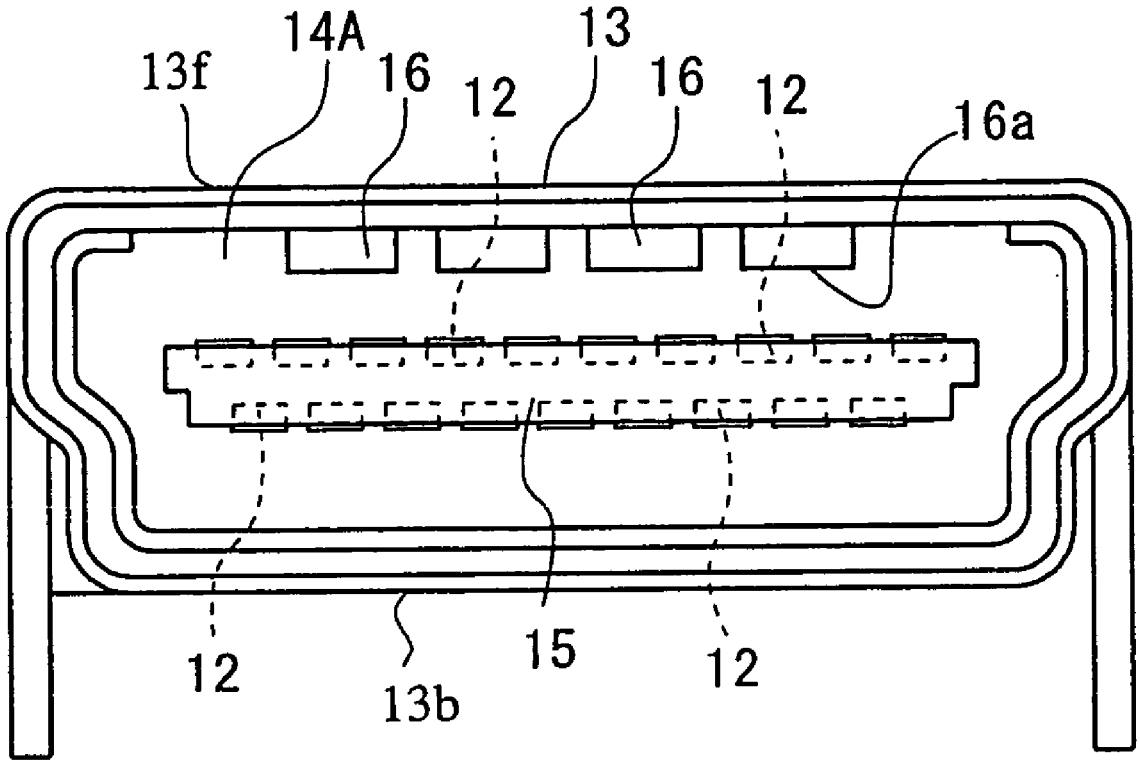
FIG. 4 is a front view of the connector on the side of the base board according to the first embodiment of the present invention.
Figure 5:
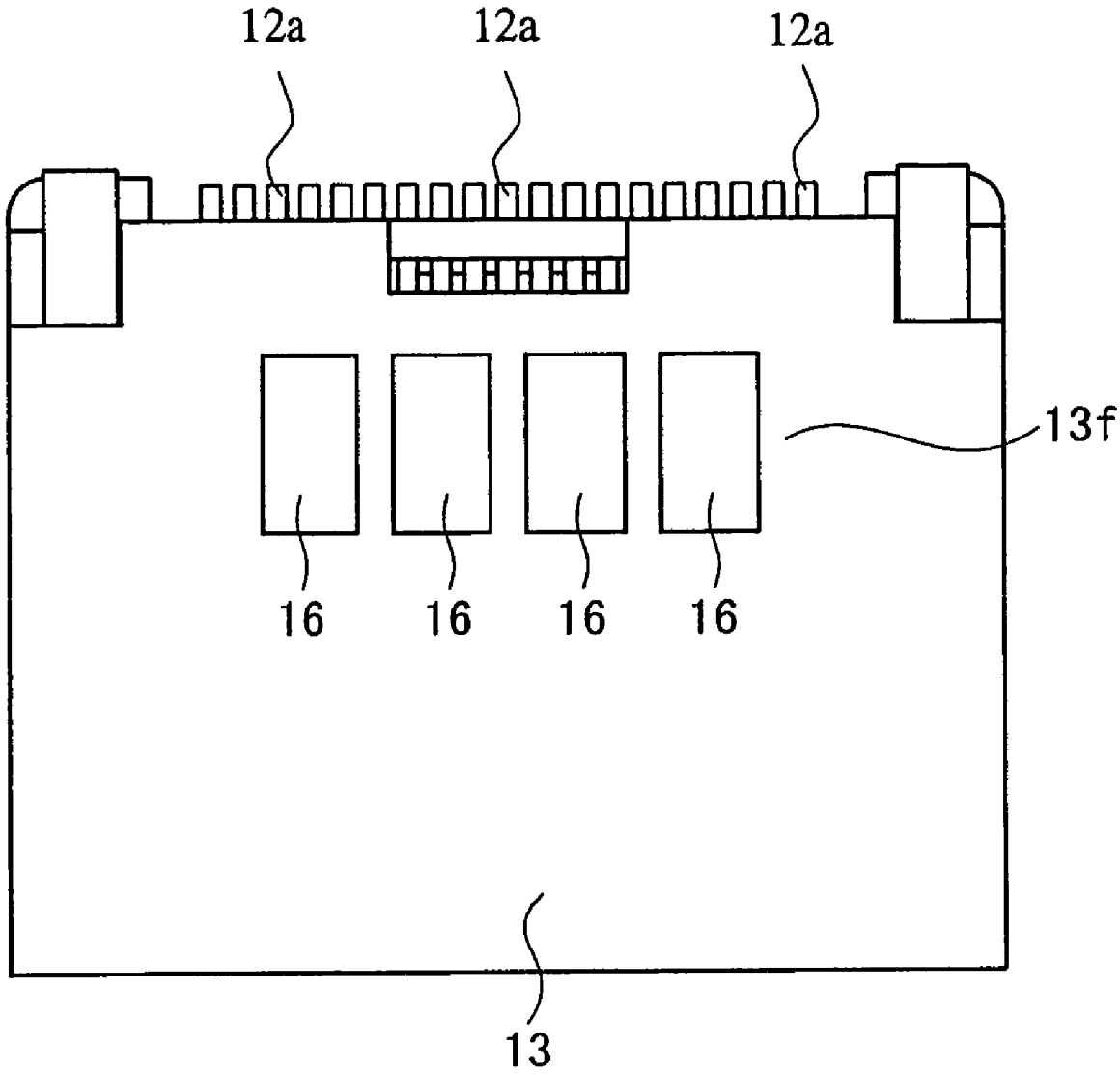
FIG. 5 is a plan view of the connector on the side of the base board according to the first embodiment of the present invention.
Figure 6:
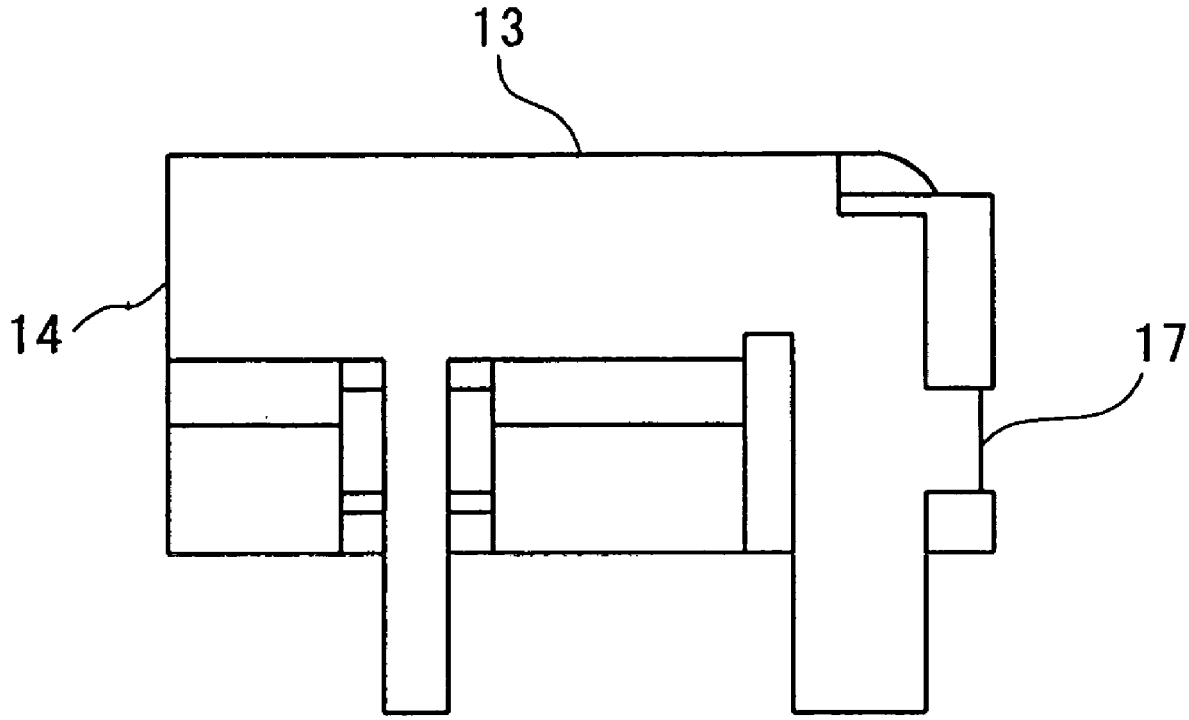
FIG. 6 is a side view of the connector on the side of the base board according to the first embodiment of the present invention.

An embodiment in which the present invention is applied to a high speed transmission connector of a portable communication device will be described below. FIG. 1 is a cross-sectional view showing, for the convenience sake, the essential portions of connectors according to a first embodiment of the present invention. FIG. 2 is a perspective view of a connector mounted on a print base board (hereinafter referred to simply as "the base board side connector") of the first embodiment. FIG. 3 is a cross-sectional view of the connector.

Namely, in a general view, the connection as shown in FIG. 1 is accomplished by connecting a connector for a differential transmission cable (hereinafter referred to simply as "the cable side connector") shown in FIG. 8 to the connector mounted on the base board shown in FIG. 2 and FIG. 3. Details will be described below.

The high speed transmission connector in accordance with this embodiment includes a base board side connector 10 and a cable side connector 20 which are connected with each other. Each connector 10, 20 includes a contact 12, 22 disposed within a housing 11, 21 and a metal shell 13, 23 for covering the housing 11, 21.

As shown in FIG. 1, the connector 10 mounted on the base board includes the housing 11 made of an insulating resin, a plurality of contacts 12 provided in the housing 11 by a pressure fitting or an insert molding, and a metal shell 13 provided so as to cover the outside of the housing 11 except for an opening portion 14.

The opening portion 14, which is an engaging portion, is provided at one end of the housing 11 as shown in FIG. 2, into which the cable side connector 20 is inserted and engaged. That is, a hollow portion 14A is formed inside the opening portion 14, and into this hollow portion, an engaging portion 23*c* of the cable side connector 20 and further the contact 22 provided inside the engaging portion 23*c* are inserted.

At the center portion in the hollow portion 14A, a plate shape contact support 15 is projected toward the opening portion 14.

Each contact 12 is mounted in such manner that a part thereof is embedded in the upper surface and the lower surface of the contact support 15. That is, each contact 12 is provided on the top and the bottom of the contact support portion 15 and arranged with a space between the adjacent contacts in a widthwise direction (in a direction indicated by an arrow A in FIG. 2) of the base board side connector 10.

Further, each contact 12 is arranged with a displacement by a half pitch between on the top surface and the bottom surface of the contact support 15. With this arrangement, tails 12*a* can be arranged in a single row with high density, thereby to provide a desirable base board mounted connector which does not consume an area on the base board for surface mount. (For the sake of convenience for describing the embodiment of this invention, the top and the bottom contacts 12 and 22 are shown on the same vertical section in FIG. 1 and FIG. 8.)

In theses contacts 12, although depending on the usage of contact, the number of poles in the transmission path, and the like, generally, the ground contacts and the signal contacts that form the transmission path of the high frequency signal are so arranged to be adjacent to one another in use.

As shown in FIG. 1, the metal shell 23 of the cable side connector 20 is inserted into the metal shell 13 of the base board side connector 10 so that the metal shells 13, 23 and the contacts 12, 22 are electrically connected to each other, respectively.

Figure 8:
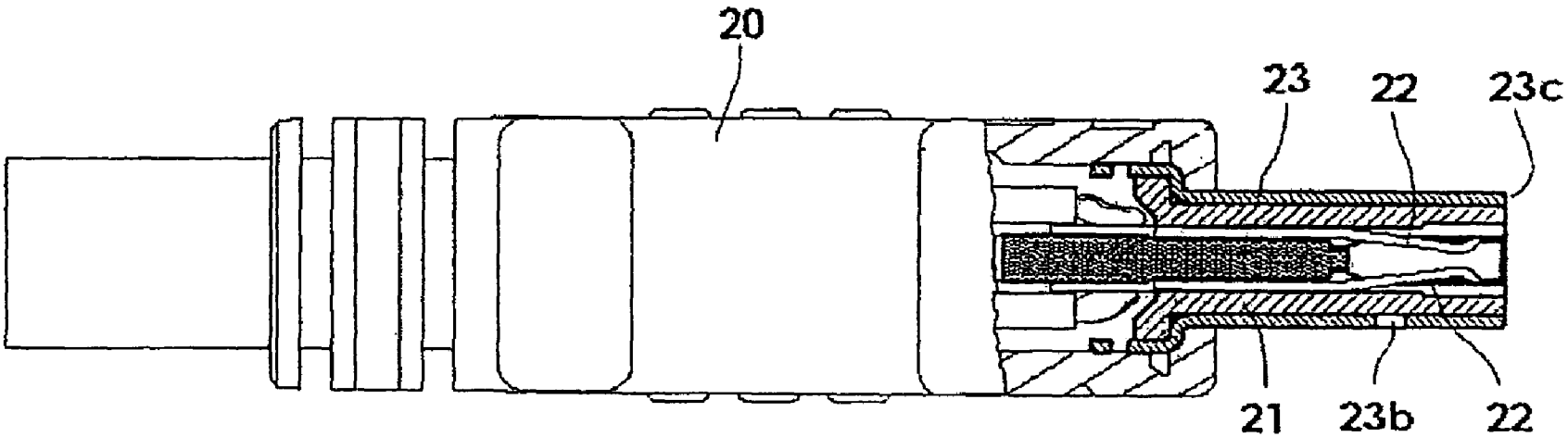
FIG. 8 is a partial sectional view of the connector on the side of the cable according to each embodiment of this invention.

As shown in FIG. 8, the cable side connector 20 has, within the forward end portion thereof, the contact 22 comprises a spring member, thereby the housing 21 is surrounded by the metal shell 23.

The connector according to this embodiment has a remarkable feature in that a recess portion 16, such as the depression or dimple shown, is provided in plural in the metal shell 13 of the base board side connector 10, for adjusting the space between metal shell 13 and the contacts 12 in the base board side connector 10.

The reason why the recess portions 16 are provided is to attempt matching of the impedance by the effect of these recess portions 16. Here, the recess portions 16 are formed by a press-machining (embossing) of the metal shell 13. In the case of the press-machining, the depth of the recess portions 16 may easily be adjusted. Therefore, it is possible to adjust the impedance by these recess portions 16 with ease. The reason for this is that the impedance of the base board side connector 10 changes greatly by a space between the metal shell 13 and the contact 12.

With the embodiment shown in FIG. 1, the space between the contact 12 and the recess portion 16 in the base board side connector 10 is set to be substantially equal to the portion where the cable side connector 20 is inserted and its metal shell 23 is lying over an inner surface of the metal shell 13. That is, as shown in FIG. 1, the inner surface (the inner surface just below the recess portion 16) 16*a* corresponding to the recess portion 16 of the metal shell 13 and an inner surface 23*a* of the metal shell 23 of the cable side connector 20 are so set in substantially the same plane.

As a result, the respective spaces between the contact 12 and the metal shells 13, 23 become substantially equal to one another through the whole length of the base board side connector 10 and the cable side connector 20, thereby the impedance in this portion is matched with each other.

As shown in FIG. 2, the recess portion 16 of the metal shell 13 of the base board side connector 10 is provided in plural. Of course, a single large recess portion may be provided as the recess portion 16. However, in the case where, for example, the recess portion 16 is formed by the press-machining, it is advantageous to form a plurality of recess portions because the press-machining is facilitated and the mechanical strength of the metal shell 13 may be easily secured. Further, in the case of the plurality of contacts 12 are provided, the plurality of recess portions can be set to correspond to the respective contacts with high precision.

The contact 12 of the base board side connector 10 is provided in plural and they are arranged with a space between the adjacent contacts in the widthwise direction of the base board side connector 10. By arranging the contacts 12 in the widthwise direction of the base board side connector 10, not only the high density is obtained, but also to facilitate the respective contacts 12 to correspond to the respective recess portions 16.

The respective recess portions 16 are in the form of a flat rectangular shape and, in this embodiment, four recess portions are provided with a space between the adjacent recess portions in the widthwise direction of the base board side connector 10. Thus, it is possible to arrange the respective recess portions 16 with respect to the metal shell 13 at a high density without difficulty.

Figure 7:
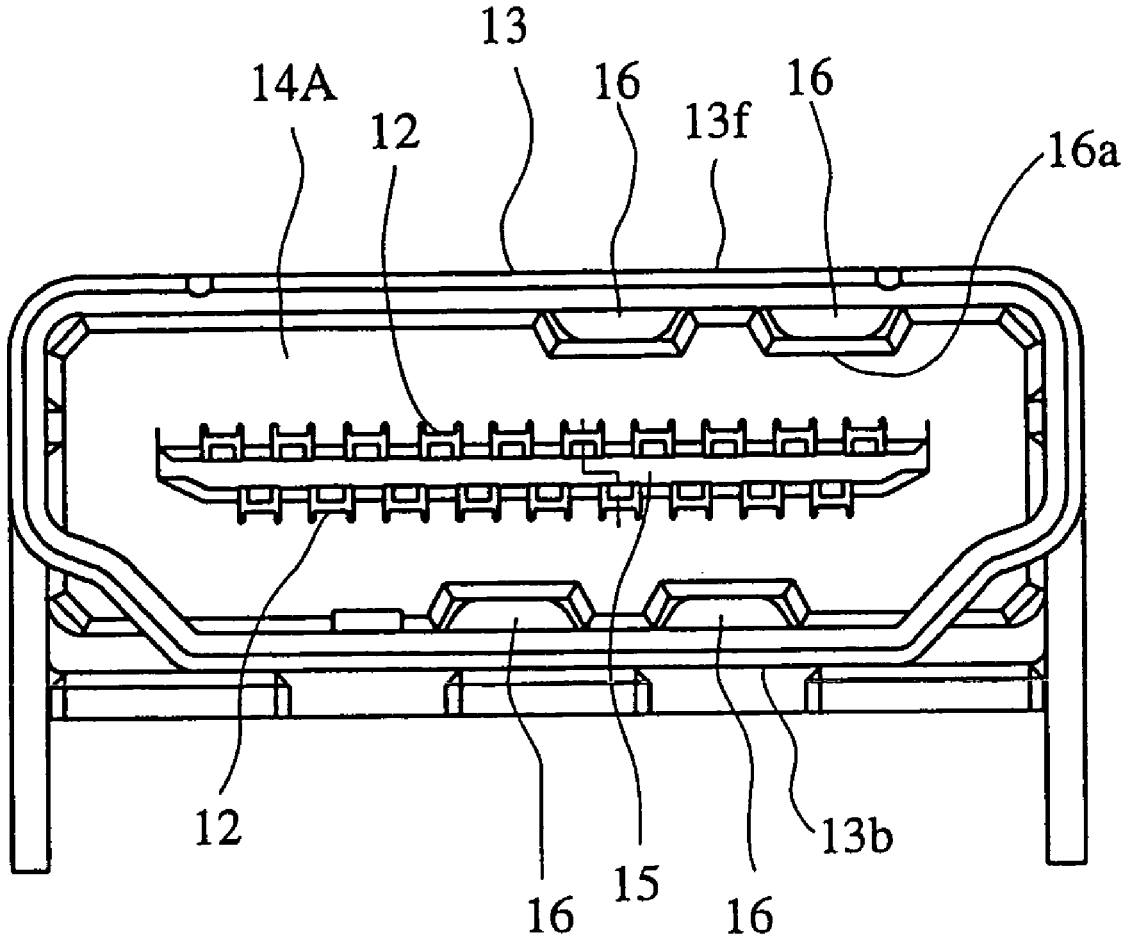
FIG. 7 is a front view of the connector on the side of the base board according to a second embodiment of this invention.

Next, a second embodiment will be described based on FIG. 7. In the above-described first embodiment, the respective recess portions 16 are provided in an upper surface 13*f* of the metal shell 13, but in the second embodiment, the recess portions are provided in both the upper surface 13*f* and a lower surface 13*b*. This arrangement is to prevent degradation of signals in a more preferable mode based on the arrangement of differential signals.

Throughout the two embodiments, the recess portions 16 are provided adjacent to the opening portion 14 where the cable side connector 20 is inserted and engaged. With this structure, it is possible to avoid the adverse influence on the region C of the coupling portion of the connectors by the existence of the recess portions 16. That is, the recess portion 16 projects from the inner surface 13*a* of the metal shell 13 but is displaced from the region C of the coupling portion of the connectors. Therefore, it is possible to obtain a structure that is good in attempting miniaturization and thinning of the connector with higher density.

As can be understood from FIG. 1, the forward end of the metal shell 23 of the cable side connector 20 may be formed, by utilizing the projected bottom portion of the recess portion 16, to be a stopper with which the engaging portion 23*c* is brought into contact, thereby the engaging position for the two connectors can be defined.

In order to ensure the electrical connection of the metal shells 13, 23 with each other, an engagement piece 18 is provided on the metal shell 13 of the base board side connector 10 for engaging with the metal shell 23 of the cable side connector 20. This engagement piece 18 can exhibit a locking function in addition to an effect to ensure the electrical connection of the metal shell 13, 23 with each other.

This locking function is constructed of a convex portion 18*a* provided in the engagement piece 18, and an engagement hole 23*b* provided in the metal shell 23 of the cable side connector 20 such that the convex portion 18*a* can be engaged. The locking functions may be provided in plural as required.

With the high speed transmission connector according to the present invention, it is possible to adjust the characteristic impedance through an easy method and also to cope sufficiently with the miniaturization of the connector and making it with a higher density. In particular, since the recess portion is provided for adjusting a space between the contact and the metal shell within one connector, it is possible to match the impedance by the effect of this recess portion. That is, the recess portion is provided not by a separate member, but may be easily formed in a desired size by a press-machining the metal shell or the like. In addition, it is easy to adjust a depth of the recess portion. Therefore, it is easy to adjust the impedance by means of this recess portion.

While a preferred embodiment of the present invention is shown and described, it is envisioned that those skilled in the art may devise various modifications of the present invention without departing from the spirit and scope of the appended claims.

The invention claimed is:

1. A receptacle connector for mating to an opposing plug connector, the opposing plug connector having an insulative housing supporting a plurality of terminals and an outer conductive shell, the receptacle connector comprising:

an insulative housing supporting a plurality of terminals, the plurality of terminals including at least one pair of differential signal terminals, said terminals each including contact portions and tail portions and body portions that interconnect said contact and tail portions together;

a conductive outer, hollow shell that at least partially encloses the housing and said terminals and defines a hollow receptacle into which the opposing plug connector may be inserted so that an outer surface of said opposing plug connector outer shell abuts an inner surface of said receptacle connector outer shell, the terminal contact portions being disposed within the receptacle connector outer and the terminal body portions being supported by said housing within said shell;

said shell including at least one depression formed therein and disposed adjacent to said housing and the depression being further aligned with a body portion of at least one pair of said differential signal terminals, said depression having a front edge proximate to a front edge of said housing, the depression front edge forming a stop surface against which a leading edge of said opposing plug connector outer shell abuts when said opposing plug connector outer shell is fully inserted into said receptacle connector.

2. The receptacle connector of claim 1, wherein said depression is formed as a dimple in said shell.

3. The receptacle connector of claim 2, wherein said dimple has a body portion that is collinear with said opposing plug connector outer shell.

4. The receptacle connector of claim 2, wherein said dimple has a body portion and said receptacle connector outer shell has a first inner surface that is spaced apart from said terminal contact portions a first distance and said dimple defines a second inner surface of said receptacle connector outer shell, different than the receptacle connector outer shell first inner surface, the receptacle connector outer shell second inner surface being spaced closer to said terminal body portions than said receptacle connector outer shell first inner surface is spaced from said terminal contact portions.

5. The receptacle connector of claim 4, wherein said dimple extends over said body portions of said differential signal terminals.

6. The receptacle connector of claim 4, wherein said dimple is rectangular in configuration.

7. A connector for use in high speed applications, the connector comprising:

an insulative housing, the housing having a body portion with a front face and a support portion extending forwardly of the body portion front face;

a plurality of conductive terminals supported by said housing, the terminals including body portions supported in said housing body portion and contact portions supported by the housing support portion, the contact portions being exposed forwardly of said housing front face, the terminal tail portions being exposed proximate a rear end of said housing;

a metal shell covering said housing, the metal shell having a body portion that is spaced from said terminal contact portions a first distance, and said metal shell further including a plurality of non-flexable depressions formed therein and disposed in opposition to said terminal body portions, the depressions each having a bottom portion that is spaced from said terminal body portions a second distance, the second distance being less than said first distance, whereby said depressions affect impedance of said terminals in said body portions;

wherein said non-flexible depressions include front edges that provide a stop surface for an opposing mating connector.

8. The connector of claim 7, wherein said depression bottom portions are disposed adjacent said housing.

9. The connector of claim 7, wherein said terminals are spaced apart from each other widthwise along said housing support portion.

10. The connector of claim 9, wherein said depressions are spaced apart from each other widthwise along said shell.

11. The connector of claim 9, wherein said depressions are spaced apart from each other widthwise along said shell and each of said depressions is aligned with a pair of terminals.

12. The connector of claim 7, wherein said depressions are rectangular in shape.

13. The connector of claim 7, wherein said metal shell includes four depressions.

14. The connector of claim 7, wherein said depressions are disposed in a top portion of said metal shell.

15. The connector of claim 7, wherein said depressions are disposed in top and bottom portions of said metal shell.

* * * * *